US007864060B2

(12) United States Patent
Smith et al.

(10) Patent No.: US 7,864,060 B2
(45) Date of Patent: Jan. 4, 2011

(54) WETNESS DETECTION DEVICE

(76) Inventors: Dean Preston Smith, 616 Scotswood Cir., Knoxville, TN (US) 37919; Edward Roger Adams, 763 Highway 310, Englewood, TN (US) 37329

( * ) Notice: Subject to any disclaimer, the term of this patent is extended or adjusted under 35 U.S.C. 154(b) by 306 days.

(21) Appl. No.: 12/198,032

(22) Filed: Aug. 25, 2008

(65) Prior Publication Data

US 2009/0021382 A1 Jan. 22, 2009

Related U.S. Application Data

(63) Continuation-in-part of application No. 12/218,698, filed on Jul. 17, 2008, now abandoned.

(60) Provisional application No. 60/959,815, filed on Jul. 17, 2007.

(51) Int. Cl.
*G08B 23/00* (2006.01)

(52) U.S. Cl. ..... 340/573.5; 340/604; 604/361; 128/886; 24/499

(58) Field of Classification Search ..... 340/573.5, 340/604, 605, 691.1; 604/361; 128/886; 24/455, 489, 499
See application file for complete search history.

(56) References Cited

U.S. PATENT DOCUMENTS

| | | | | |
|---|---|---|---|---|
| 4,796,014 | A * | 1/1989 | Chia | 340/573.5 |
| 7,595,734 | B2 * | 9/2009 | Long et al. | 340/573.5 |
| 2010/0031481 | A1 * | 2/2010 | Lo | 24/499 |

* cited by examiner

*Primary Examiner*—Jeffery Hofsass
(74) *Attorney, Agent, or Firm*—Baumgartner Patent Law; Marc Baumgartner

(57) ABSTRACT

The teachings herein are directed to devices for detecting and signaling the presence of urine or another electrically conducive liquid in an undergarment, fabric, or other thin material. Preferred devices include a clip configured to safely and releasably secure a liquid detecting sensor to a fabric or undergarment, wherein said sensor is operably coupled to a detection device that emits a notification signal when liquid is present in the fabric.

21 Claims, 6 Drawing Sheets

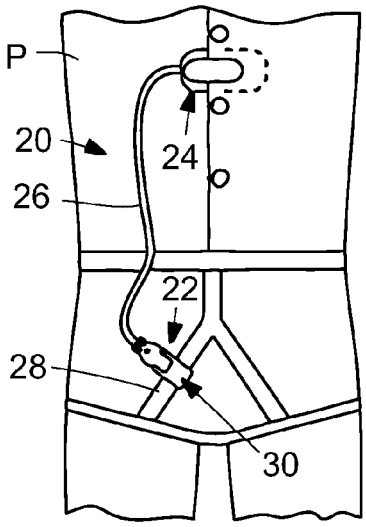
FIG. 1
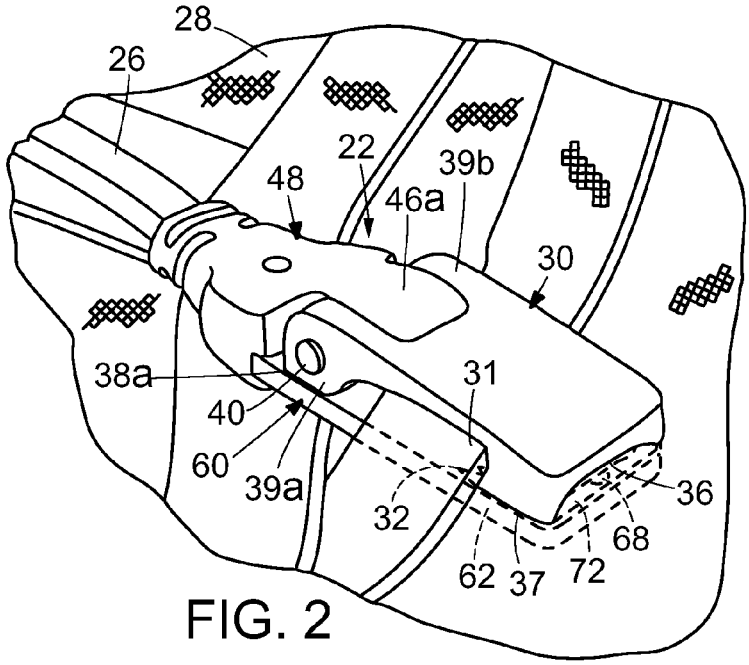
FIG. 2
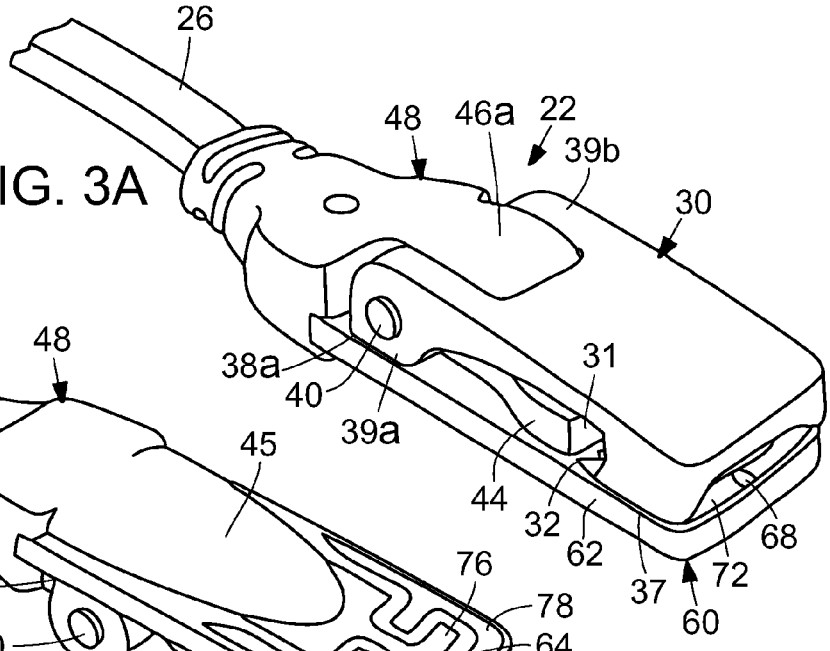
FIG. 3A
FIG. 3B

WETNESS DETECTION DEVICE

CROSS-REFERENCE TO RELATED APPLICATION

This application claims the benefit of U.S. Provisional Application 60/959,815 filed Jul. 17, 2007, and is a continuation-in-part of U.S. Non-Provisional application Ser. No. 12/218,698, filed Jul. 17, 2008, now abandoned both of which are expressly incorporated by reference herein in their entireties.

FIELD OF THE INVENTION

The embodiments herein generally relate to novel clips and a wetness sensor configured to safely and securely releasably attach to a fabric, such as an undergarment. According to more preferred embodiments, the wetness sensors provided herein are configured to electronically communicate, via a cord or wirelessly, to a notification component adapted to emit an alarm when wetness is detected in the fabric.

BACKGROUND OF THE INVENTION

Wetness detection sensors configured to work with notification components are known in the art and are useful in helping a user deal with incontinence. The sensor is configured to detect wetness in or around a fabric such as an undergarment and is in electronic communication with a notification component configured to emit an alarm (e.g., audio, visual, or vibratory) to alert the wearer when wetness is detected by the sensor. If the user is sleeping as they begin to urinate in their clothing, the alarm will wake them up quickly so they can finish urinating in a toilet instead of on themselves.

Unfortunately many problems exist with the current systems. For example, some sensors do not have adequate means for safely and securely releasably attaching to a fabric. This is an important problem because if the sensor is not securely and effectively fastened, it will not be able to detect the presence of liquid in the fabric. Likewise, many fastening devices are inadequate as they can cause injury or pain to the user. An additional problem in the current systems is that the non-sensing electronic elements on the wetness sensors are often not adequately protected from the urine. A further problem is that some sensors are not configured to be quickly and adequately cleaned for re-use after coming into contact with urine. Accordingly, it is an objective of the present invention to provide a single wetness detection device that overcomes these problems in the art.

SUMMARY OF THE INVENTION

Preferred embodiments are directed to a device for sensing a conductive liquid in a thin material and comprising: (a) a liquid-sensing printed circuit board (PCB), wherein the PCB comprises an electrode assembly having means for detecting a conductive liquid in the thin material based on a change in electrical resistance in the electrode assembly and means for emitting an electronic signal when the liquid is detected; (b) a resilient overmold body partially molded over the PCB such that it covers the means for emitting an electronic signal while allowing exposure of the means for detecting a conductive liquid; and (c) a clip configured for clamping and unclamping the PCB to the thin material and having a proximal area pivotally hinged to the overmold body and a distal area configured to releasably hold the fabric in contact with the electrode assembly.

Further embodiments are directed to devices where a portion of the clip comprises a plurality of retruded teeth pointed toward the resilient overmold body. Advantageously, the teeth are retruded such that they are parallel to the PCB, or substantially so, when the clip is clamped to the PCB. Preferably, the clip's distal area comprises a generally planar gripping surface configured to press the fabric in contact with the electrode assembly and a plurality of retruded teeth arranged in a row. Advantageously, at least one tooth is coplanar with the gripping surface of the clip, or substantially so.

According to preferred embodiments, the resilient overmold body gradually rises up in a distal direction from the proximal area of the PCB to form a knuckle and then steeply descends to a leveled, or substantially so, thin lobe portion positioned on the surface of the PCB such that it protrudes distally away from the hinged knuckle and is configured to engage the thin material against the clip when in a clamped down position. Preferably, the lobe portion comprises a bump, that can be positioned medially and distally on the lobe portion of the resilient overmold body.

Further embodiments are directed to a device configured for clamping onto a thin material, comprising: (a) a rigid base layer, having proximal and distal areas, a topside and a bottom side; (b) a resilient overmold body molded over the rigid base layer's proximal area while allowing substantial exposure of the distal area; and (c) a clip configured to be movable into an open and closed position with respect to the rigid base layer and having a proximal area pivotally hinged to the overmold body and a distal area comprising a gripping surface and a plurality of retruded teeth configured such that the gripping surface presses the thin material into the distal area of the rigid base layer and the teeth engage the thin material.

Advantageously, the overmold body covers the proximal areas of both the topside and bottom-side of the rigid base layer. The overmold body advantageously gradually rises up in a distal direction from the proximal area of the rigid base layer to form a knuckle and then steeply descends to a leveled, or substantially so, thin lobe portion. The lobe portion of the overmold body can comprise a bump positioned distally and medially on the lobe portion. The retruded teeth can be configured to be parallel or substantially so with the rigid base layer when the clip is in the closed position.

Still further embodiments are directed to a device for sensing a conductive liquid in a thin material, comprising: (a) a liquid-sensing printed circuit board (PCB), wherein the PCB comprises an electrode assembly having means for detecting a conductive liquid in a thin material based on a change in electrical resistance in the electrode assembly and means for emitting an electronic signal when the liquid is detected; (b) a notification component having means for receiving said signal and means for emitting an alarm when said signal is received; (c) a resilient overmold body partially molded over the PCB such that it covers the means for emitting a signal while leaving the means for detecting a conductive liquid exposed; and (d) a clip for clamping and unclamping the PCB to the thin material and having a proximal area pivotally hinged to the overmold body and a distal area configured to releasably hold the fabric in contact with the electrode assembly and the resilient overmold body. The thin material can be carpet, a garment, fabric, and the like, for example. Said electronic signal can be wireless or be sent through a two-wire cord. Preferably, the overmold body gradually rises up in a distal direction from the proximal area of the PCB to form a knuckle and then steeply descends to a leveled, or substantially so, thin lobe portion. Advantageously, the lobe portion of the overmold body comprises a bump positioned distally and medially on the lobe portion.

BRIEF DESCRIPTION OF THE DRAWINGS

FIG. 1 is a schematic view of an exemplary embodiment of a wetness detection device clipped to an undergarment and operably coupled to a notification component.

FIG. 2 is a perspective view of an exemplary embodiment of a wetness detection device clipped to an undergarment.

FIG. 3A is a perspective topside view of an exemplary embodiment of a wetness detection device.

FIG. 3B is a perspective underside view of an exemplary embodiment of a wetness detection device.

DETAILED DESCRIPTION OF THE INVENTION

Embodiments of the present invention are described below with reference to the above described Figures. It is however, expressly noted that the present invention is not limited to these embodiments, but rather the intention is that modifications that are apparent to the person skilled in the art and equivalents thereof are also included.

Figure 4:
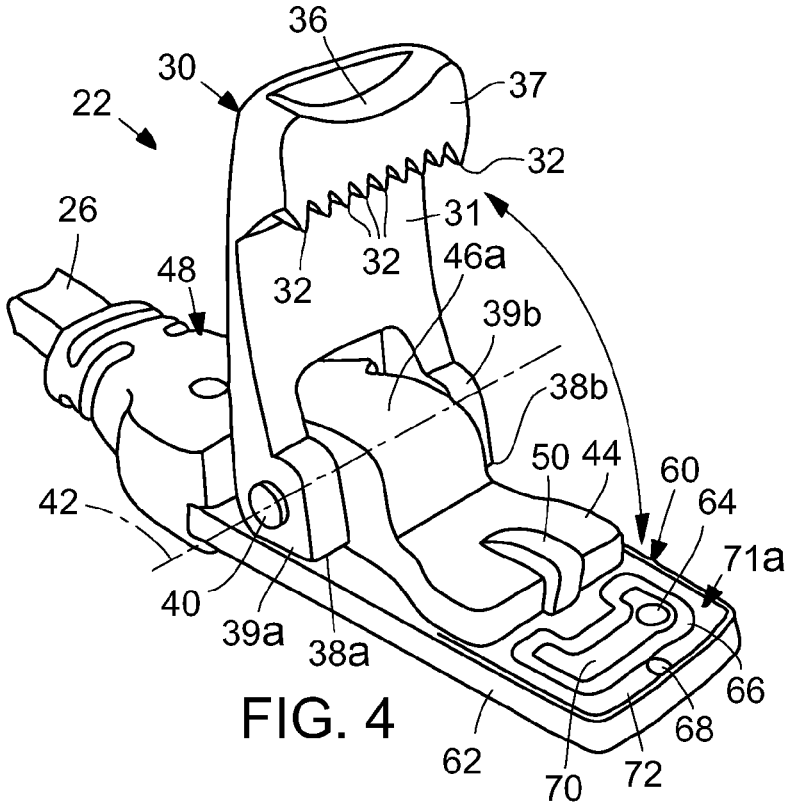
FIG. 4 is a perspective view of an exemplary embodiment of a wetness detection device in an opened position.
Figure 5A:
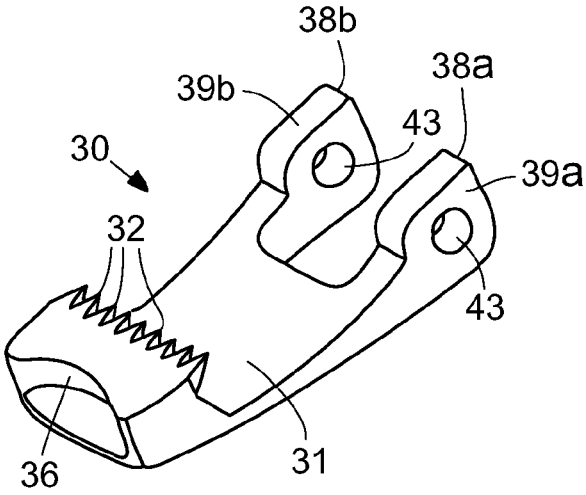
FIGS. 5A-5B are perspective views of an exemplary embodiment of a clip, separated from the wetness detection device.
Figure 5B:
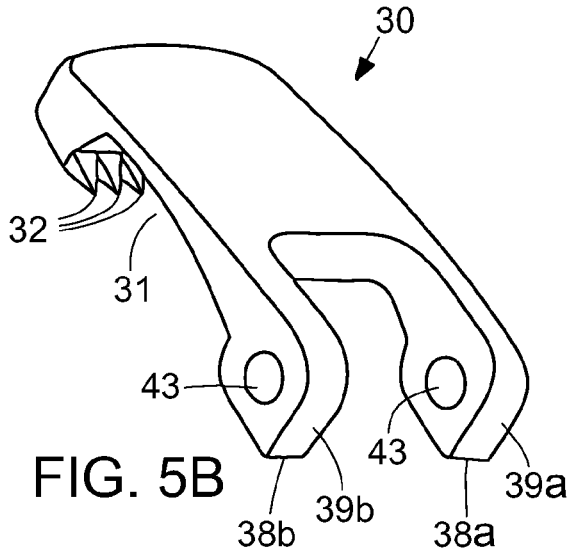
Figure 7A:
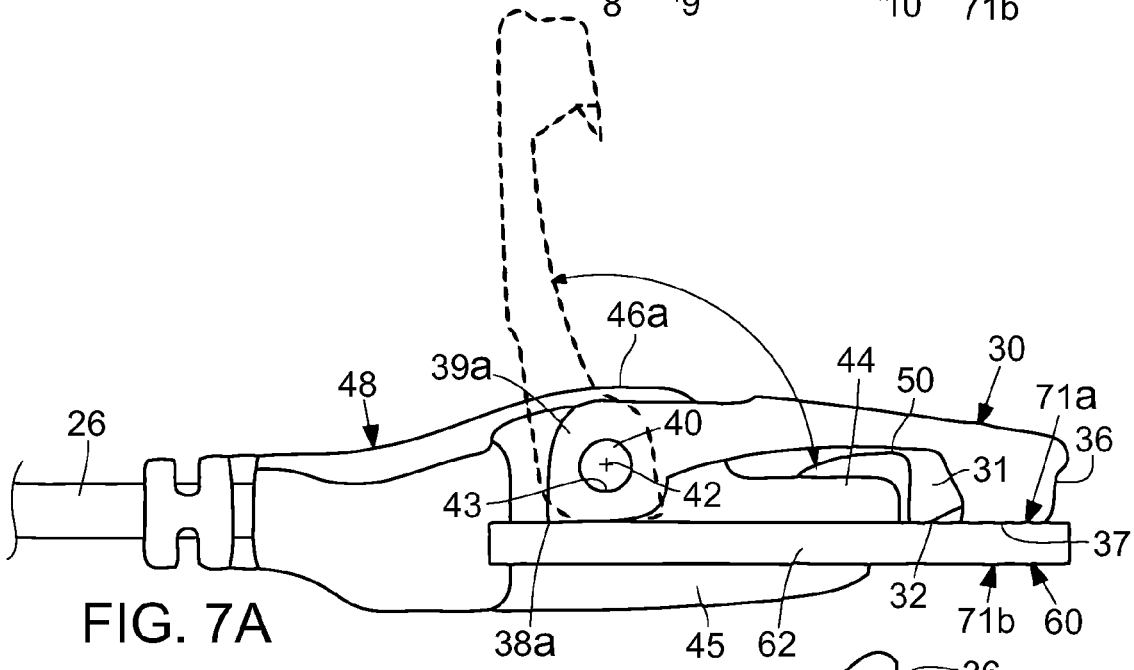
Figure 7B:
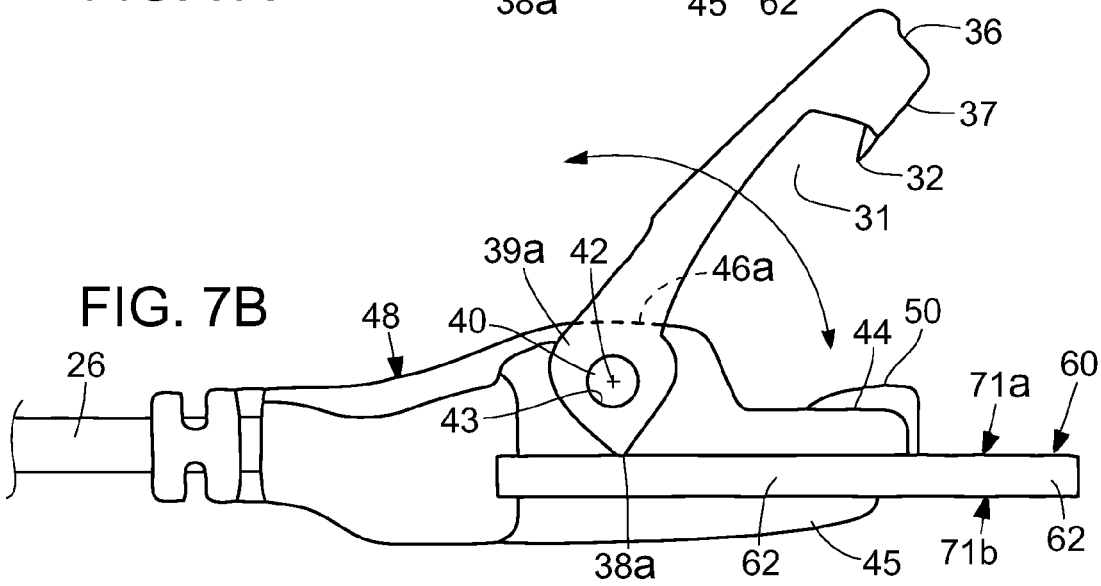
Figure 8:
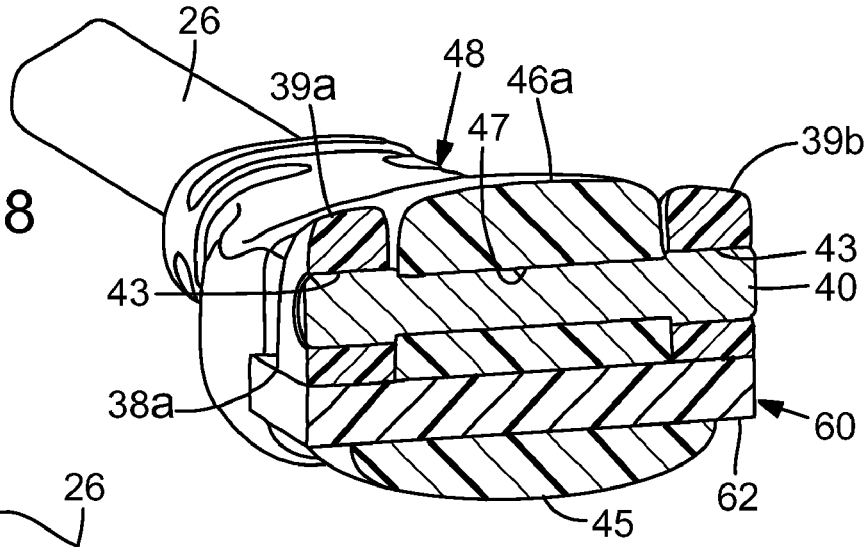
FIGS. 8-10 are cross-sectional views of an exemplary embodiment of a wetness detection device.
Figure 9:
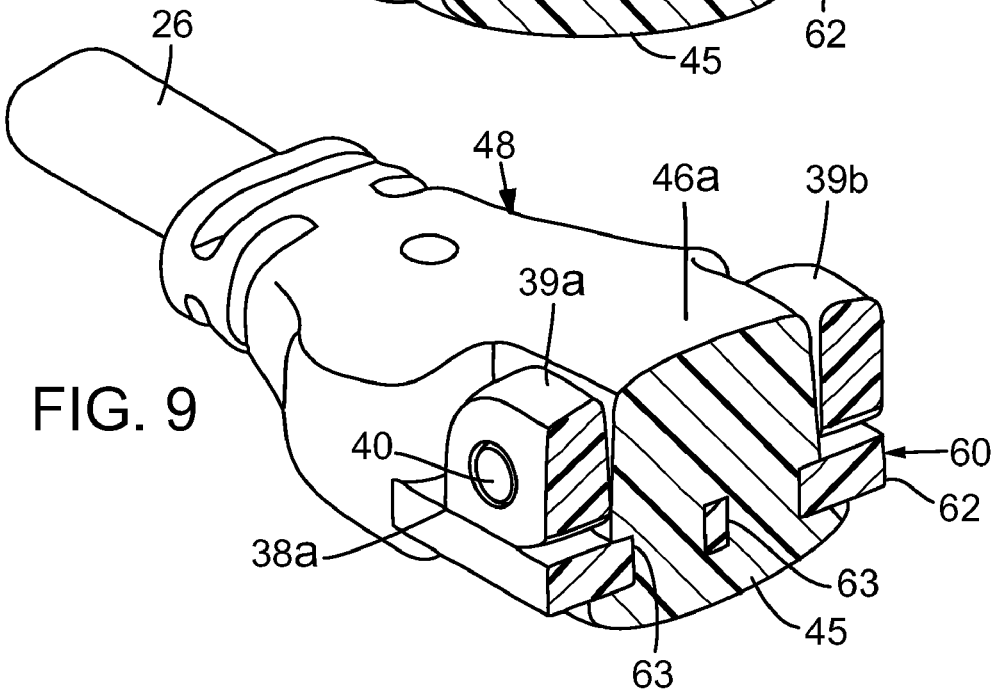
Figure 10:
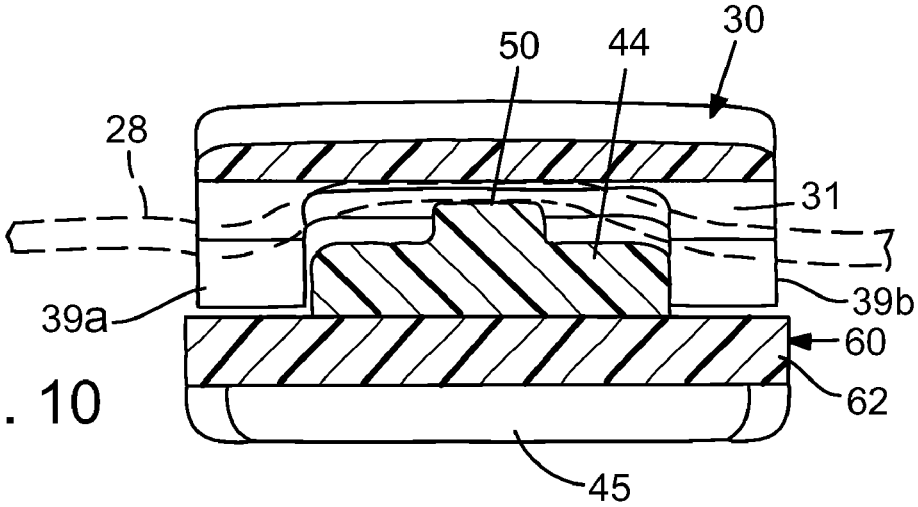
Figure 11:
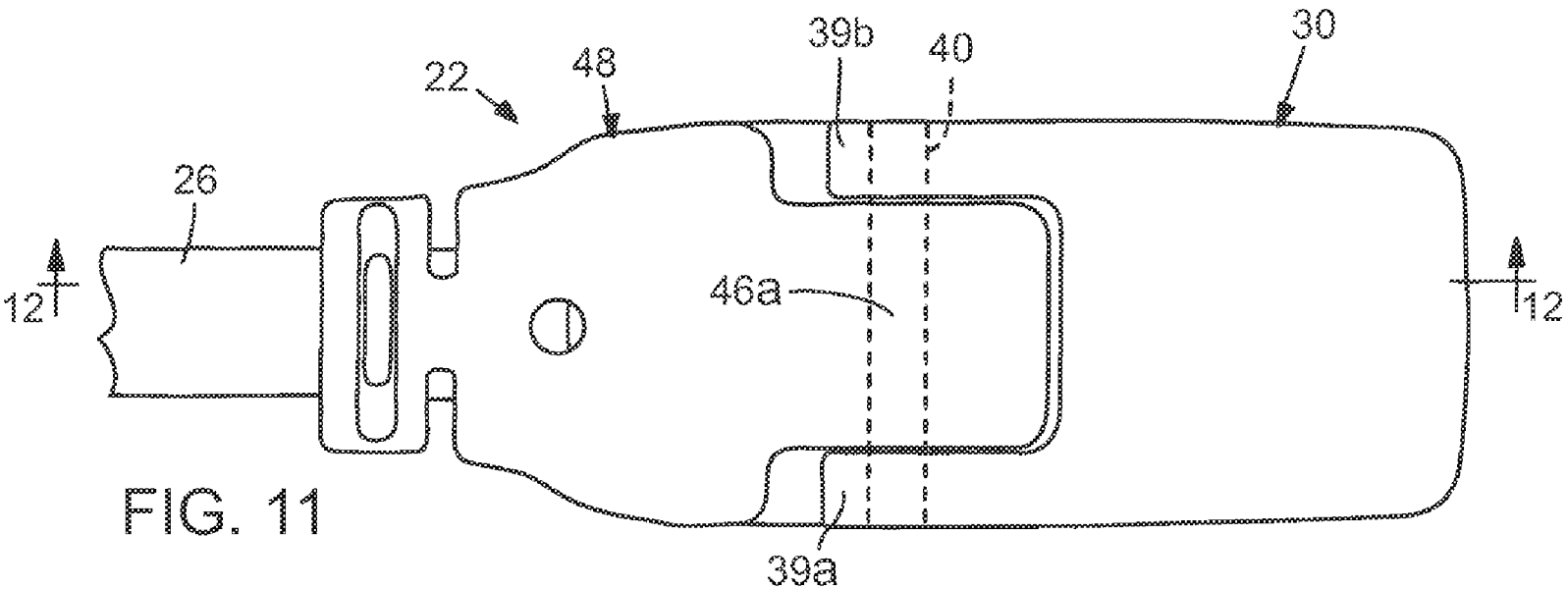
FIG. 11 is a plan view of an exemplary embodiment of a wetness detection device.
Figure 12:
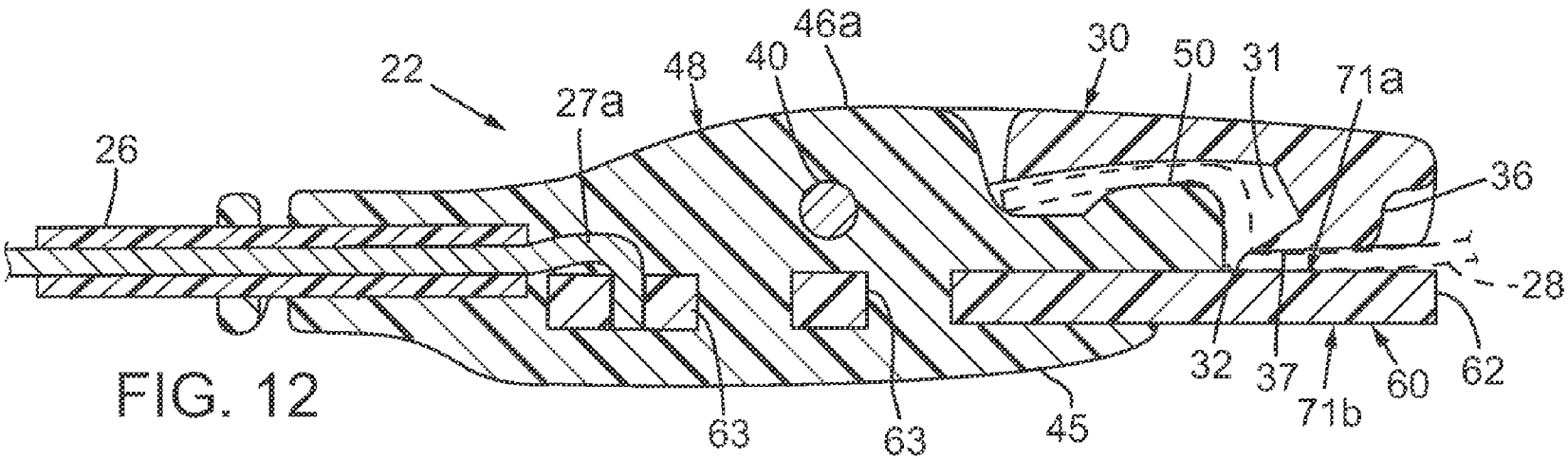
FIG. 12 is a cross-sectional view of an exemplary embodiment of a wetness detection device.
Figure 13:
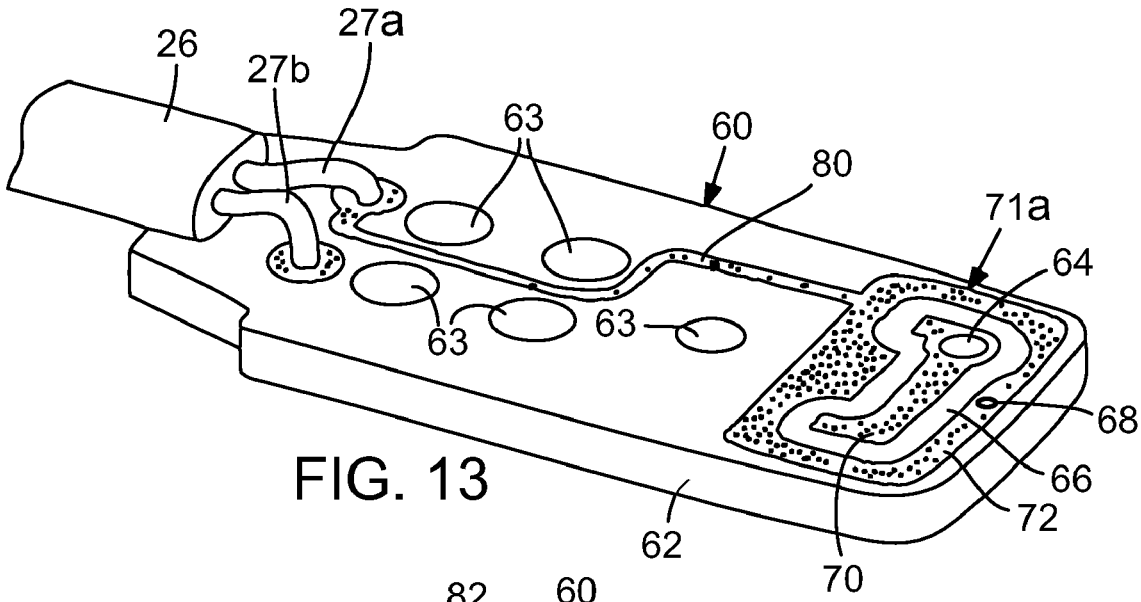
FIG. 13 is a perspective topside view showing a wetness-sensing printed board with the resilient overmold body and clip removed to show the electronic circuitry.
Figure 14:
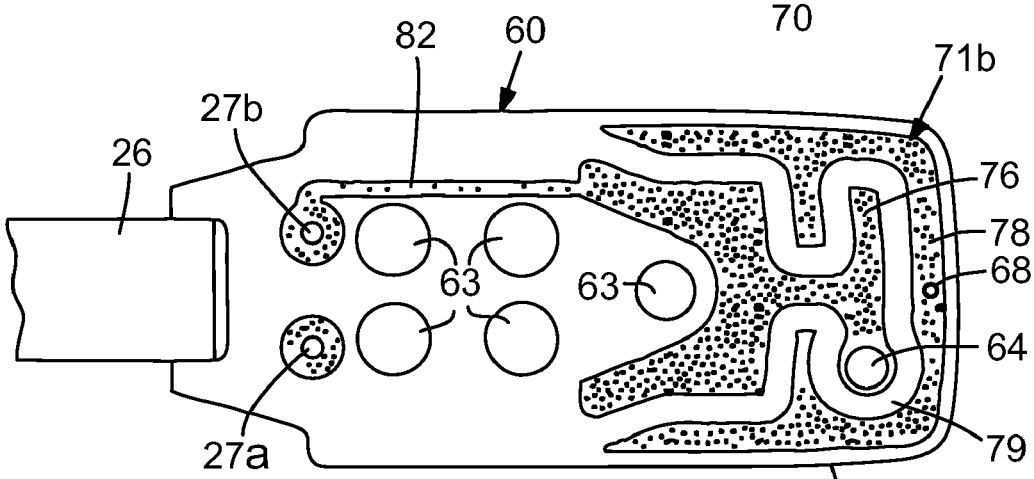
FIG. 14 is a plan underside view showing a wetness-sensing printed board with the resilient overmold body and clip removed to show the electronic circuitry.
Figure 15:
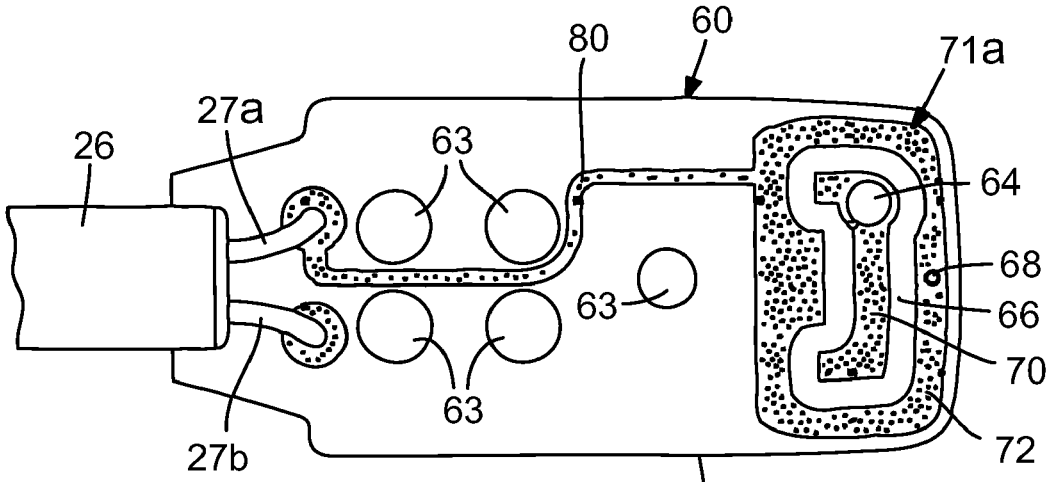
FIG. 15 is a plan topside view showing a wetness-sensing printed board with the resilient overmold body and clip removed to show the electronic circuitry.

According to preferred embodiments, the teachings herein are directed to a wetness-detection device 22 having a wetness-sensing printed board 60, a resilient overmold body 48 partially molded over the printed board 60, and operably coupled to a clip 30. More specific embodiments include the proximal end of the clip 30 hinged to the overmold body 48 such that the clip 30 can be moved from an open and closed position, as depicted in FIGS. 7A-7B. More specifically, FIG. 4 depicts a clip 30 in an open position, where it can advantageously receive a fabric, such as an undergarment 28. FIG. 3A shows the clip 30 in a closed position unattached to a fabric, while FIG. 2 depicts the clip 30 in a closed position, clamping an undergarment 28. Once the undergarment 28 or fabric is positioned into the area 31 between the clip 30 and the printed board 60, the opened clip 30 can be pressed toward the printed board 60 to a closed position to securely lock the undergarment 28 to the printed board 60 (See FIG. 2, for example). When desired, the closed clip 30 can be reopened to release the wetness-detection device 22 from the fabric.

The wetness-sensing printed board 60 preferably includes a rigid base layer 62 that includes a top electrode assembly 71*a* and a bottom electrode assembly 71*b* that are each individually configured to detect a conductive liquid in an undergarment 28, or fabric. Non-rigid substrates can also be used as the base layer 62 in other embodiments. Further, non-preferred embodiments are directed to printed boards 60 only having a top electrode assembly 71*a* or a bottom electrode assembly 71*b*, but not both. The top electrode assembly 71*a* includes an electrical circuit preferably having an outer electrode 72 separated by a non-conductive (or weakly conductive) gap 66 from an oppositely charged inner electrode 70. The top electrode assembly 71*a* also preferably includes a connecting segment 80 that connects one of the top electrodes 70 or 72 to the top connecting wire 27*a*.

Likewise, the bottom electrode assembly 71*b* also includes a circuit that preferably includes an outer electrode 78 separated by a non-conductive (or weakly conductive) gap 79 from an oppositely charged inner electrode 76. The bottom electrode assembly 71*b* also preferably includes a connecting segment 82 that connects one of the bottom electrodes 76 or 78 to the bottom connecting wire 27*b*. In a preferred embodiment, a plated through hole 64 that traverses through the base layer 62 electronically connects the inside pair of like-charged electrodes 70 and 76 and a solid connector 68 that traverses through the base layer 62 electronically connects the outside pair of like-charged electrodes 72 and 78.

Preferably, the connecting segments 80 82 and connecting wires 27*a* 27*b* can be positioned proximally and medially on the printed board 60 such that they are covered by the resilient overmold body 48. In a preferred embodiment, the printed board 60 also includes a portion having one or more anchor holes 63 for anchoring the resilient overmold body 48 to the wetness-sensing board 60 during overmolding.

According to certain embodiments, the pair of oppositely charged electrodes 70 72 of the top electrode assembly 71*a* and the pair of oppositely charged electrodes 76 78 of the bottom electrode assembly 71*b* can define an open circuit (or a weak circuit having high resistance) in their natural state where conductive matter is not present in their respective gaps 66 79. The high resistance between the electrode pairs 70 72 and 76 78 is detectable by the notification component 24 within the complete wetness detection alarm system 20. When a conductive liquid, such as urine enters into one or more gaps 66 79, the electrical resistance between the electrodes 70 72 and/or 76 78 is lowered as the circuit closes or becomes more conductive. This change in lowered resistance from the natural state of the electrode pairs 70 72 and/or 76 78 is quickly communicated to the notification component 24 causing it to emit an alarm.

Preferably, the wetness-detection device 22 can be operably coupled to the notification component 24 by a two-wire cord 26 or by wireless means to form a complete wetness detection alarm system 20. In a preferred embodiment a two-wire cord 26 provides a means for connecting the present invention to a notification component 24, wherein the two-wire cord 26 divides into a top-connecting wire 27*a* to electronically connect the top electrode assembly 71*a*, and into a bottom-connecting wire 27*b* to electronically connect the bottom electrode assembly 71*b*. Preferred two-wire cords 26 can be configured to a variety of lengths. For example, the length can be very short such that the notification component 24 is proximal to or integral with the wetness detection device 22. Alternatively the length of the two-wire cord 26 can be longer such as shown in FIG. 1. According to wireless embodiments, the change in resistance can be communicated from the wetness detection device 22 as a wireless signal to the notification component 24 that includes means for receiving the wireless signal and means for emitting an alarm based on said signal.

Upon activation, the notification component 24 is preferably configured to emit any type of suitable alarm. Preferred alarms can be visual, audible, vibrating, or a wireless signal emitted to another remote device, or a combination thereof. Preferred notification components 24 can contain their own power source, such as a battery, and are configured to quickly detect a change in resistance in the wetness detection device 22 and to quickly emit a sufficient alarm based on the change in resistance. A sufficient alarm generally relates to one that is activated near the start of accidental urination, such that the wearer will quickly wake up and finish urinating in a toilet, instead of in their undergarment or clothing. Accordingly the teachings herein are of great advantage to those suffering incontinence or enuresis. Preferred notification components 24 are readily known in the art, such as those disclosed in U.S. patent application Ser. No. 10/950,795, Publication No. US 2005/0110644 A1, filed Sep. 27, 2004 which is expressly incorporated by reference in its entirety. Preferred wetness detection devices 22 are configured to work compatibly with said notification components 24, and other suitable devices.

The resilient overmold body 48 preferably covers: the proximal end and the middle of the printed board 60, the connecting wires 27*a* 27*b*, anchor holes 63, and the connecting segments 80 82 of the top and bottom electrode assemblies 71*a* 71*b*. Preferably, the resilient overmold body 48 gradually rises up in a distal direction from the proximal area of the printed board 60 to form a knuckle 46*a* and then steeply descends to a leveled, or substantially so, thin lobe portion 44. Advantageously the knuckle 46*a* is configured to allow the clip 30 to hinge to it. The knuckle 46*a* covers: a proximal area of the printed board 60, one or more anchor holes 63, and a portion of the connecting segment 80. Preferably, the lobe portion 44 covers: a middle area of the printed board 60, and one or more anchor holes 63 and the remainder of the connecting segment 80. Advantageously, the overmold body 48 does not cover the inner and outer oppositely charged electrodes 70 and 72 or the gap 66 that separates them.

The lobe portion 44 preferably includes a distal medial bump 50 in the form of a quarter-ellipsoid that gradually slopes upward and distally from the middle of the lobe portion 44 and steeply descends at the distal end of the lobe portion 44. This preferred bump 50 allows for differential biasing, or clamping of the undergarment against the clip's teeth 32. Alternative shapes (e.g., quarter-spherical, rectangular, triangular), numbers (e.g., 2, 3, 4), sizes, and position of bumps (e.g., off-center, near the periphery of the lobe portion 44) can vary in other embodiments. Preferably when the clip 30 is in the closed position there is a small space 31 between lobe portion 44 and the underside of the clip 30 and the distal medial bump 50 and the underside of the clip 30. This space is 31 is configured to receive fabric or an undergarment 28. When clamped to an undergarment 28, the clip 30 is configured to hold the undergarment 28 against the top electrode assembly 71*a* and the lobe portion 44 and the distal medial bump 50, as shown in FIG. 2.

Preferably, the resilient overmold body 48 forms a thin underside layer 45 over a proximal and middle area of the printed board 60 and covers: one or more anchor holes 63 and the connecting segment 82. Advantageously, the underside layer 45 does not cover the inner and outer oppositely charged electrodes 76 and 78 or the gap 79 that separates them.

In an exemplary embodiment of the present invention, the clip 30 includes a proximal area configured to hinge to the resilient overmold body 48, more preferably the clip 30 is configured to hinge to the knuckle 46*a*. Advantageously, the clip's proximal end can include a pair of pin guides 39*a* and 39*b* that are configured to straddle the knuckle 46*a*.

The pin guides 39*a* 39*b* individually include a pivot pin hole 43 configured to allow a pivot pin 40 to traverse through. Preferably, the hinge knuckle 46*a* includes an interior pin opening 47 that aligns with the pivot pin holes 43 when the pin guides 39*a* and 39*b* straddles the hinge knuckle 46*a* and define a hinge axis 42. Under this preferred configuration, the pivot pin 40 acts as a hinge for the clip 30 and the overmold body 48. In a more specific embodiment of the hinging mechanism, a portion of the knuckle 46*a* can define end-openings for the pivot pin 43 that have a greater diameter than an interior pin opening 47.

Preferably, the pin guides 39*a* 39*b* can individually include heels 38*a* 38*b* to give the clip 30 over-center action to set a spring force in the hinge knuckle 46*a* to snap and hold the clip 30 shut as the heels 38*a* 38*b* goes past center when the clip 30 is moved toward a closed position. More specifically when the clip 30 is an open position at a ninety degree angle to the base layer 62 and is moved toward the base layer 62, the spring mechanism will cause the clip 30 to snap shut when it is past forty-five degrees, or substantially so. (See FIG. 7*a*) However, other hinging and spring mechanisms could be employed and other means for generating a clamping force to hold the clip 30 into the closed position could be employed.

Figure 6:
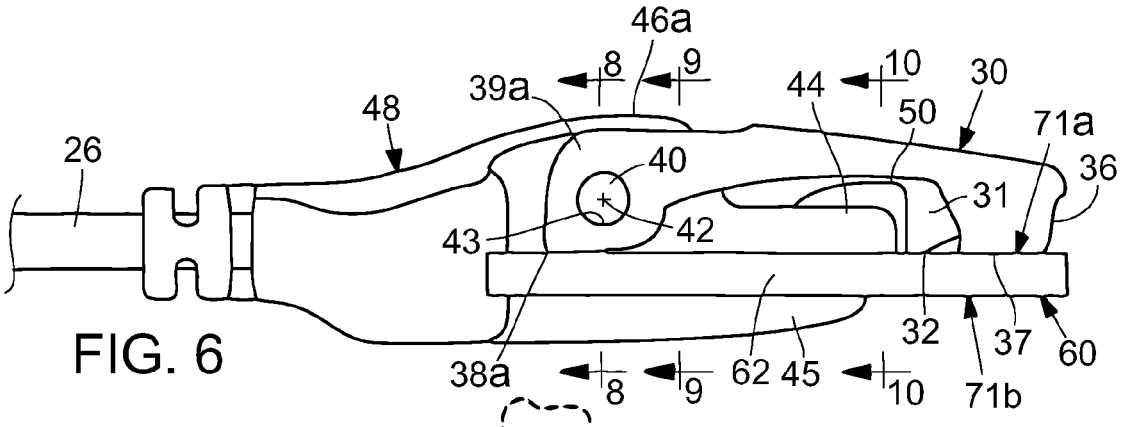
FIGS. 6, 7A-7B are plan views of an exemplary embodiment of a wetness detection device.

According to further embodiments, the distal area of the clip 30 includes a protruding gripping surface 37 where the face of the gripping surface 37 is parallel with the printed board 60 when the clip 30 is in the closed position. When the clip 30 is in the open position as shown in FIG. 4, the face of the gripping surface is preferably perpendicular to the printed board 60. It is preferred that the gripping surface 37 is planar, or substantially so, but other embodiments can include a textured or angled gripping surface. In a preferred embodiment, the gripping surface 37 is configured to contact the top electrodes 70 72 when the clip is in a closed position and unattached to a piece of fabric or undergarment 28 as shown in FIG. 6. The top electrode assembly 71*a* acts as a sensing strike plate in this embodiment. When a fabric or an undergarment 28 is clamped down by the clip 30, the gripping surface 37 is configured to hold the fabric or undergarment 28 against the top electrode assembly 71*a*.

The distal area of the clip 30 preferably includes one or more retention teeth 32. More specifically, the gripping surface 37 can include a row of retruded teeth 32. In further embodiments, the teeth 32 are retruded such that they are parallel to the printed board 60 and point toward the resilient overmold body 48 as shown in FIG. 3A and FIGS. 6-7B when the clip 30 is in the closed position and unattached to fabric or an undergarment 28. In this position there is preferably a small space between the end of teeth 32 and the one or more bumps 50. Additionally, when the clip 30 is in an open position (FIG. 4) the teeth 32 are preferably configured to be perpendicular with the printed board 60 such that they point downward towards the printed board 60 and the overmold body 48.

More specifically, the teeth 32 can be configured to engage the undergarment 28 or fabric against the resilient overmold body 48, and even more preferably against the lobe portion 44 and the one or more bumps 50. The combination of the gripping surface's 37 clamping force and the grabbing effect of the teeth 32 make it very difficult for the fabric or undergarment 28 to accidentally disengage with the wetness detection device 22. The retruded configuration of the teeth 32 also add a safety feature in that it makes it very difficult for the pointy tips to puncture or hurt the wearer.

The distal end of the clip 30 preferably includes a release notch 36 where a person can insert their finger to lift the clip 30 from the closed position to an open position. The release notch is preferably a concave crescent shape notched into the gripping surface 37, but can be other suitable shapes.

While preferred embodiments herein are directed to fastening a wetness detection device 22 to an undergarment 28, those with skill in the art will recognize that the clips 30 described herein can be attached to any other suitable fabric, or thin material for detection of any conductive liquid. For example, the wetness detection devices 22 described herein can be used to attach to carpets, rugs, or carpet pads in an area susceptible to flooding, such as a basement, for example. Additionally, the wetness detection devices 22 described herein can be used to attach to plastic sheeting in a crawl space, for example.

Additionally, the clips 30 and overmold bodies 48 described herein can be used without a printed board 60, and can be simply used to attach light-weight items to clothing or other materials against a base layer 62 (rigid or non-rigid). Accordingly a rigid base layer 62 alone can be substituted for a printed board 60 in the embodiments described above. According to these embodiments, the clips 30 can be used to fasten a name tag to a user's shirt or to tether emergency stop keys for personal watercraft (e.g., WAVERUNNER® and JET SKI® brands) and exercise machines (e.g., treadmills and stepping machines) to the user.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

The invention claimed is:

1. A device for sensing a conductive liquid in a thin material, comprising:

(a) a liquid-sensing printed circuit board (PCB), wherein the PCB comprises an electrode assembly having means for detecting a conductive liquid in the thin material based on a change in electrical resistance in the electrode assembly and means for emitting an electronic signal when the liquid is detected;

(b) a resilient overmold body partially molded over the PCB such that it covers the means for emitting an electronic signal while allowing exposure of the means for detecting a conductive liquid; and (c) a clip configured for clamping and unclamping the PCB to the thin material and having a proximal area pivotally hinged to the overmold body and a distal area configured to releasably hold the fabric in contact with the electrode assembly.

2. The device in claim 1, wherein a portion of the clip comprises a plurality of retruded teeth pointed toward the resilient overmold body.

3. The device in claim 2, wherein the teeth are retruded such that they are parallel to the PCB, or substantially so, when the clip is clamped to the PCB.

4. The device in claim 1, wherein the clip's distal area comprises a generally planar gripping surface configured to press the fabric in contact with the electrode assembly and a plurality of retruded teeth arranged in a row.

5. The device in claim 4, wherein at least one tooth is coplanar with the gripping surface of the clip, or substantially so.

6. The device in claim 5, wherein the resilient overmold body gradually rises up in a distal direction from the proximal area of the PCB to form a knuckle and then steeply descends to a leveled, or substantially so, thin lobe portion positioned on the surface of the PCB such that it protrudes distally away from the hinged knuckle and is configured to engage the thin material against the clip when in a clamped down position.

7. The device in claim 6, wherein said lobe portion comprises a bump.

8. The device of claim 7, wherein the bump is positioned medially and distally on the lobe portion of the resilient overmold body.

9. A device configured for clamping onto a thin material, comprising:

(a) a rigid base layer, having proximal and distal areas, a topside and a bottom side;

(b) a resilient overmold body molded over the rigid base layer's proximal area while allowing substantial exposure of the distal area; and (c) a clip configured to be movable into an open and closed position with respect to the rigid base layer and having a proximal area pivotally hinged to the overmold body and a distal area comprising a gripping surface and a plurality of retruded teeth configured such that the gripping surface presses the thin material into the distal area of the rigid base layer and the teeth engage the thin material.

10. The device of claim 9, wherein the overmold body covers the proximal areas of both the topside and bottom-side of the rigid base layer.

11. The device of claim 10, wherein the overmold body gradually rises up in a distal direction from the proximal area of the rigid base layer to form a knuckle and then steeply descends to a leveled, or substantially so, thin lobe portion.

12. The device of claim 11, wherein the lobe portion of the overmold body comprises a bump.

13. The device of claim 12, wherein the bump is positioned distally and medially on the lobe portion.

14. The device of claim 12, wherein the retruded teeth are configured to be parallel or substantially so with the rigid base layer when the clip is in the closed position.

15. A device for sensing a conductive liquid in a thin material, comprising:

(a) a liquid-sensing printed circuit board (PCB), wherein the PCB comprises an electrode assembly having means for detecting a conductive liquid in a thin material based on a change in electrical resistance in the electrode assembly and means for emitting an electronic signal when the liquid is detected;

(b) a notification component having means for receiving said signal and means for emitting an alarm when said signal is received;

(c) a resilient overmold body partially molded over the PCB such that it covers the means for emitting a signal while leaving the means for detecting a conductive liquid exposed; and (d) a clip for clamping and unclamping the PCB to the thin material and having a proximal area pivotally hinged to the overmold body and a distal area configured to releasably hold the fabric in contact with the electrode assembly and the resilient overmold body.

16. The device of claim 15, wherein the thin material is carpet.

17. The device of claim 15, wherein the thin material is a garment.

18. The device of claim 15, wherein said electronic signal is wireless.

19. The device of claim 15, wherein the overmold body gradually rises up in a distal direction from the proximal area of the PCB to form a knuckle and then steeply descends to a leveled, or substantially so, thin lobe portion.

20. The device of claim 19, wherein the lobe portion of the overmold body comprises a bump.

21. The device of claim 20, wherein the bump is positioned distally and medially on the lobe portion.

* * * * *